US006804838B2

(12) United States Patent
Lacus

(10) Patent No.: US 6,804,838 B2
(45) Date of Patent: Oct. 19, 2004

(54) FLEXIBLE DIAPHRAGM FOR CLEARING OBSTRUCTION IN A PLUMBING FIXTURE

(76) Inventor: Richard G Lacus, R.F.D. 682, Edgartown, MA (US) 02539

( * ) Notice: Subject to any disclaimer, the term of this patent is extended or adjusted under 35 U.S.C. 154(b) by 0 days.

(21) Appl. No.: 10/361,871

(22) Filed: Feb. 10, 2003

(65) Prior Publication Data

US 2004/0154086 A1 Aug. 12, 2004

(51) Int. Cl.[7] ..... E03D 9/00
(52) U.S. Cl. ..... 4/255.01; 4/300.3
(58) Field of Search ..... 4/255.01, 255.07

(56) References Cited

U.S. PATENT DOCUMENTS 4,922,555 A * 5/1990 Bonilla et al. ..... 4/255.11
5,600,856 A * 2/1997 Kang ..... 4/255.01
5,768,719 A * 6/1998 Harvey ..... 4/255.01
6,643,854 B1 * 11/2003 Jensen ..... 4/255.01

* cited by examiner

*Primary Examiner*—Charles E. Phillips
(74) *Attorney, Agent, or Firm*—Carmody & Torrance LLP

(57) ABSTRACT

A method and apparatus for freeing an obstruction from a plumbing fixture using a flexible diaphragm. The diaphragm is constructed of flexible membrane and is adhered to a top ring of the plumbing fixture. The diaphragm is operated by allowing air into the space between the diaphragm and the wastewater through an air valve and then pushing and pulling the diaphragm to create forces of air that dislodge the obstruction.

9 Claims, 3 Drawing Sheets

FLEXIBLE DIAPHRAGM FOR CLEARING OBSTRUCTION IN A PLUMBING FIXTURE

FIELD OF THE INVENTION

The invention comprises a flexible membrane diaphragm that can be used to free obstructions from plumbing fixtures, especially toilet fixtures, and a method of using such a diaphragm for freeing obstructions from plumbing fixtures.

BACKGROUND OF THE INVENTION

The present invention is concerned with a tool for quickly and neatly removing blockages in waste line drains in the areas of S-traps and, in particular, for clearing blockages in toilet fixtures.

The clearance of obstructions in drain lines of various fixtures, in particular household toilets, is a common need in most households and often a very distasteful chore accomplished by use of plumber snakes, makeshift snakes, plungers, or repeated flushing with lots of hope that the blockage is cleared without an overflow of the appliance.

Conventional tools that are available to clean clogged drains are difficult to use, especially by the average homeowner. These conventional devices are messy to use, and, in most cases, require excessive physical efforts. Long spirally wound wire, commonly known as a snake, that is forced through the drain to the restricting material has been used in the past to dislodge obstructions in a drain. The spirally wound wire sometimes damages fixtures, becomes caught, becomes difficult to retrieve, goes into the wrong section of the pipe, is sometimes too short to reach the clogged area, requires considerable physical force to use, and creates a mess.

One of the oldest methods of clearing clogged drains utilizes a rubber plunger on a wooden handle. Repeated pumping of the plunger causes water to surge in the drain, which helps push the material through the clogged drain. The main problem with this method and apparatus of unclogging drains is the physical fatigue factor. Elderly people, handicapped, in fact, most people have trouble maintaining the constant plunging action required for dislodging difficult clogs. In addition, while the plunger is easier to use than a lumber snake, it is often not very effective in clearing certain blockages and can cause waste water to splash, necessitating the clean up of the toilet and its surrounding areas.

Various improvements on the plumber snake and plunger have been suggested to address these problems. For example, U.S. Pat. No. 5,862,534 to Clay, the subject matter of which is herein incorporated by reference in its entirety, describes a toilet drain cleaning tool that comprises an exterior cylinder having a plunger-like head, wherein the plunger face has a central aperture therein. Slidable through the central aperture is a flexible hose-like piece that is retained within the outer cylinder in the stored condition and that in the operative condition, extends its full length outward through the aperture in the plunger to snake through the drain passage to the stoppage.

Fluid pressure devices for opening clogged pipes are also disclosed in the prior art. For example, one known device used to unclog drains is a water inflatable tube that is fed into the drain line through the fixture. A flexible garden type hose is used to expand the inflatable tube, thereby exerting a pressure, which forces water through the drain. The water inflatable tube is difficult to insert into the drain line, requires the attached garden type hose to trail through the living areas in the house, and, if a rupture in the water hose occurred, would result in considerable water damage.

Another fluid pressure device disclosed by U.S. Pat. No. 5,249,311 to Rau, the subject matter of which is herein incorporated by reference in its entirety, describes a hand-held fluid pressure device for opening clogged pipes. A pressurized gas is discharged from a slidable fluid conduit, supplied by a standard gas cartridge. U.S. Pat. No. 4,768,237 to Torti, the subject matter of which is herein incorporated by reference in its entirety, describes a toilet plunger comprising a resiliently deformable plunger element and a tubular handle element connected to a supply of pressured water. The plunger is operable for applying increased pressure to an obstruction in the outlet portion of a toilet or in a drain line by supplying pressurized water to the plunger element through the tubular handle element, and it is alternatively operable as a conventional toilet plunger.

However, all of the inventions of the prior art for releasing clogged drains are usable only by submerging the device into the wastewater contained in the plumbing fixture, thus increasing the likelihood of overflowing wastewater. The inventor is unaware of any devices that can be used to remove an obstruction that do not need to be placed into the plumbing fixture.

Thus, there is a need for a household tool that is easy to use, inexpensive, simple in construction, and provides an easy way to clear a blockage with minimum effort and mess and that operates external to the plumbing fixture.

SUMMARY OF THE INVENTION

The present invention comprises a flexible diaphragm for freeing an obstruction from a plumbing fixture.

The present invention further comprises a method of freeing an obstruction from a plumbing fixture comprising the steps of:

a) cleaning and drying a top ring of the fixture;

b) positioning a diaphragm on said top ring of the fixture;

c) exposing adhesive situated on a periphery of the diaphragm and adhering the adhesive to the cleaned and dried fixture;

d) optionally, temporarily plugging an overflow pipe of the fixture;

e) lifting the diaphragm to allow air through an air valve located in the diaphragm;

f) closing the air valve; and operating the diaphragm by pushing and pulling the diaphragm until the obstruction is dislodged.

DETAILED DESCRIPTION OF THE PREFERRED EMBODIMENTS OF THE INVENTION

Figure 1:
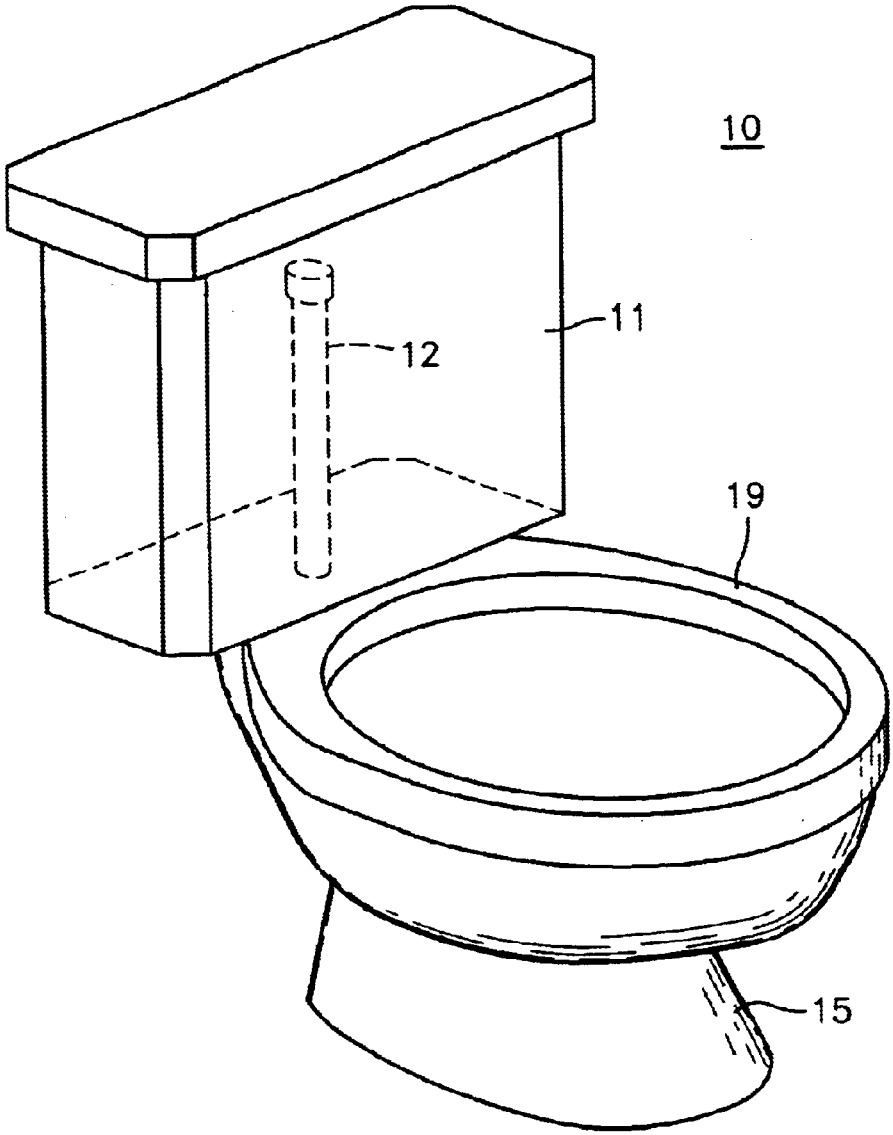
FIG. 1 is a view of a typical toilet fixture of the prior art to which a diaphragm of the present invention may be affixed.

FIG. 1 demonstrates a typical toilet or water closet design (10). Such designs are well known in the prior art. The toilet

(10) generally comprises a toilet bowl (15) having a top ring (19) and a water tank (11) for containing a volume of water used during each flush cycle of the toilet (10). The water tank (11) may further contain an overflow fill pipe (12) for replenishing the supply of water to the water tank (11) at the end of each flush cycle of the toilet (10).

Figure 2:
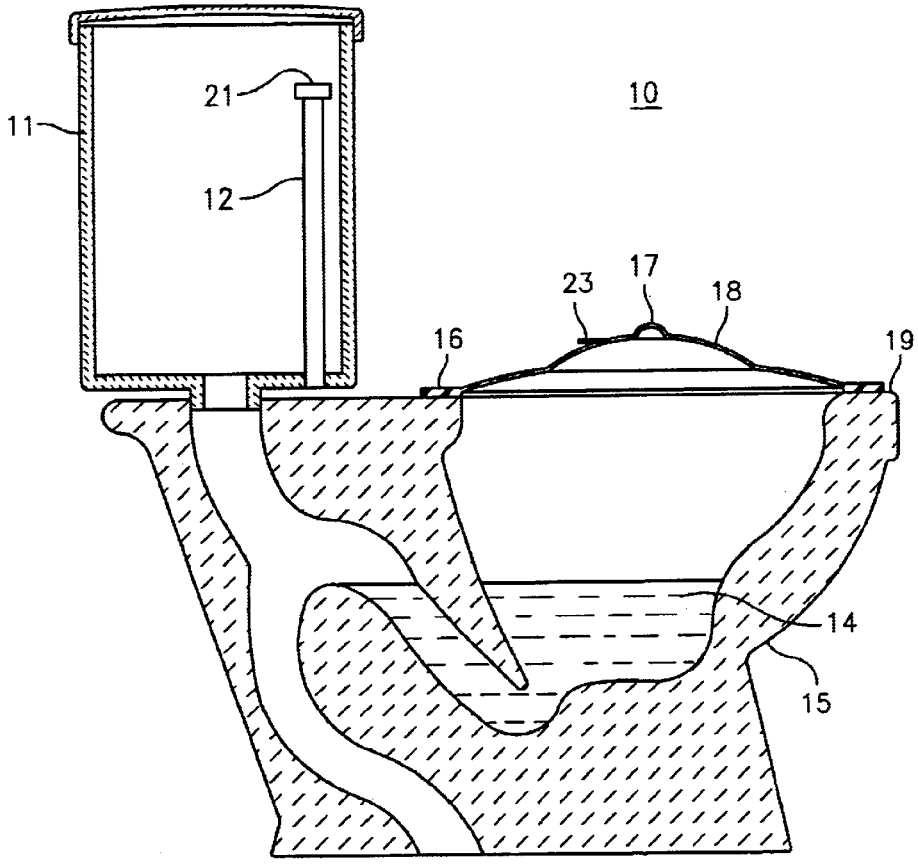
FIG. 2 is a cross-sectional view of a toilet fixture with a diaphragm of the instant invention affixed thereto.

FIG. 2 shows a plumbing fixture (10) having a diaphragm (18) of the instant invention affixed to the top ring (19) of the toilet bowl (15). The diaphragm (18) is generally constructed of flexible sheet plastic or other materials such as polymer or wax impregnated paper, fibrous polymers, rubber or other materials which can properly temporarily capture the necessary pressure, and is shaped to conform to the dimensions of the top ring (19) of the toilet bowl (15). The diaphragm (18) is preferably about 0.60 mil thick, although other thicknesses would also be usable in the instant invention as long as the diaphragm is capable of creating the necessary seal on the rim and is sturdy enough, yet flexible enough to flex in and out to create pressure differentials in the bowl.

Figure 3A:
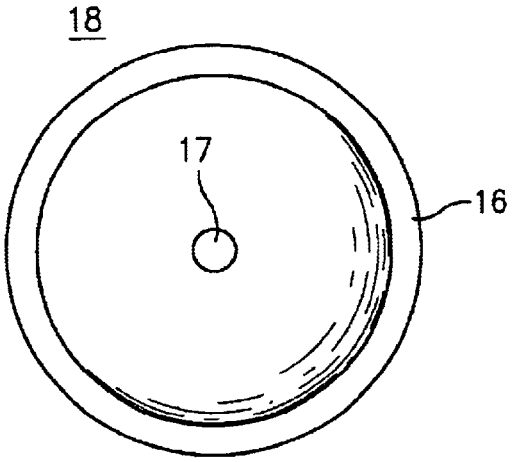
FIGS. 3A and 3B are top and side views of the diaphragm of the instant invention.
Figure 3B:
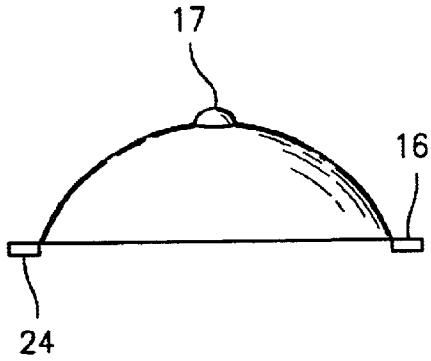
Figure 4A:
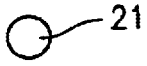
FIGS. 4A and 4B are top and side views of a plug for a fill pipe of the instant invention.
Figure 4B:
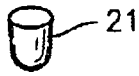
Figure 5:
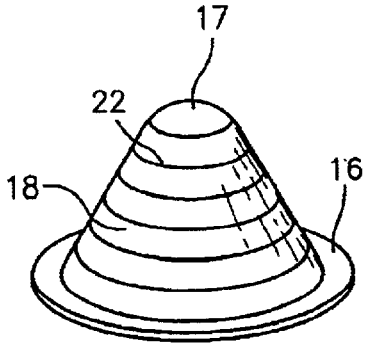
FIG. 5 is a three-dimensional view of the diaphragm of the instant invention.

As seen in the three-dimensional view of FIG. 5, the body of the diaphragm (18) generally comprises a bellows or dome portion (22) and a sealing means (16) which is preferably a temporary adhesive located around the perimeter of the diaphragm (I 8). The diaphragm (18) further preferably comprises an air valve (17), located in the center of the bellows or dome (22). The sealing means (16) is preferably continuous around the entire perimeter of the diaphragm (18) so that a seal can be made between the diaphragm (18) and a top portion (19) of the fixture. When an adhesive is used as the sealing means, as seen in FIG. 3B, the sealing means (16) is covered with a removable paper protective layer (24). The removable protective layer (24) is removed during use of the diaphragm (18) to expose the sealing means (16) and adhere the diaphragm (18) to the top ring (19) of the toilet fixture (15). The diaphragm (18) further comprises a tab (23) for moving the diaphragm up and down.

If necessary, depending on the design of the fill pipe (12), a plug (21), as seen in FIGS. 1 and 5, can be inserted into the fill pipe (12) during operation of the diaphragm (18). If a fill pipe exists on the fixture, it is preferably plugged or sealed so that the pressure created by the action of the diaphragm does not escape through the fill pipe. When work on the fixture is completed, the plug or seal is removed.

Unlike the inventions of the prior art for clearing clogged drains, the diaphragm (18) of the instant invention is designed to be used externally. It is affixed to the top ring (19) of the toilet bowl (15) by the sealing means (adhesive) (16). Preferably, the sealing means (16) completely surrounds the perimeter of the diaphragm (18) so that the diaphragm is sealed to the top ring (19) of the toilet bowl (15).

The air valve in the diaphragm is preferably merely a small hole in the diaphragm which can be pinched or plugged after the necessary air is allowed to enter and before the plunging action begins.

By lifting up on the diaphragm (18) via the tab (23) located in the bellows or dome portion (22) of the diaphragm (18), air is drawn into the space between the diaphragm and the surface of the water (14) into toilet bowl (15) through the air valve (17). Closing the air valve (17) confines the air to that space. The trapped column of air transfers push-pull forces applied to the diaphragm (18) to the surface of the water (14), which in turn transfers those forces to the point of the blockage, thereby affecting movement of the blockage and its eventual freeing.

Once the obstruction in the drain has been dislodged, the diaphragm is removed from the plumbing fixture by opening the air valve and disengaging the sealing means (adhesive) from the top ring of the toilet fixture. Once removed, the diaphragm is preferably discarded.

A typical operation of the diaphragm is as follows:

1) Wipe the top ring of the toilet bowl to clean and dry the area.
2) Position the diaphragm on the top ring of the toilet bowl with the removable protective paper side down.
3) With the diaphragm in position, the protective paper covering between the diaphragm and the top ring is removed, revealing the adhesive. The diaphragm is then pressed down tightly on the top ring to create a seal between the diaphragm and the top ring.
4) If necessary, the overflow pipe in the water tank is temporarily plugged or scaled.
5) The diaphragm is lifted to allow air to enter through an air valve located in the diaphragm.
6) The air valve is pinched close and the diaphragm is operated by pushing and pulling a tab on the diaphragm to create forces of air on the surface of the water until the blockage is freed.

What is claimed is:

1. A method of freeing an obstruction from a plumbing fixture, comprising a top ring, a surface of water below said top ring and a layer of air above said surface of water, said method comprising the steps of:

a) positioning a diaphragm on the top ring of said fixture;

b) employing a sealing means to seal the edge of the diaphragm to the top ring of the fixture;

c) operating said diaphragm by pushing and pulling said diaphragm to create forces of air on said surface of water until the obstruction is dislodged;

wherein said diaphragm comprises a tab for operating said diaphragm.

2. A method according to claim 1, wherein said diaphragm comprises a material selected from the group consisting of flexible plastic, polymer or wax impregnated paper, fibrous polymer materials, and rubber.

3. A method according to claim 1, wherein said fixture is a toilet.

4. A method of freeing an obstruction from a plumbing fixture, comprising a top ring and a surface of water below said top ring, said method comprising the steps of:

a) positioning a diaphragm on the top ring of said fixture;

b) employing a sealing means to seal the edge of the diaphragm to the top ring of the fixture;

c) allowing air through an air valve located in said diaphragm into a space between said diaphragm and said surface of water;

d) closing said air valve by pinching it;

e) operating said diaphragm by pushing and pulling said diaphragm to create forces of air on said surface water until the obstruction is dislodged.

5. A method according to claim 4, wherein said diaphragm comprises a material selected from the group consisting of flexible plastic, polymer or wax impregnated paper, fibrous polymer materials, and rubber.

6. A method according to claim 4, wherein the diaphragm comprises a tab.

7. A method of freeing an obstruction from a plumbing fixture, comprising a top ring, a surface of water below said top ring, a layer of air above said surface of water, and an overflow pipe, said method comprising the steps of:

a) positioning a diaphragm on the top ring of said fixture;

b) employing a sealing means to seal the edge of the diaphragm to the top ring of the fixture;

c) temporarily plugging the overflow pipe;

d) operating said diaphragm by pushing and pulling said diaphragm to create forces of air on said surface water until the obstruction is dislodged; and wherein the diaphragm comprises a tab.

8. A method according to claim 7, wherein the fixture is a toilet.

9. A method of freeing an obstruction from a plumbing fixture, comprising a top ring, a surface of water below said top ring, and a layer of air above said surface of water, said method comprising the steps of:

a) positioning a diaphragm on the top ring of said fixture;

b) employing a sealing means to seal the edge of the diaphragm to the top ring of the fixture;

c) operating said diaphragm by pushing and pulling said diaphragm to create forces of air on said surface of water until the obstruction is dislodged;

wherein the sealing means comprises an adhesive which adheres the edge of the diaphragm to the top ring of the fixture; and wherein the diaphragm comprises a tab.

* * * * *